US007713315B2

(12) United States Patent
Krull et al.

(10) Patent No.: US 7,713,315 B2
(45) Date of Patent: May 11, 2010

(54) MINERAL OILS WITH IMPROVED CONDUCTIVITY AND COLD FLOWABILITY

(75) Inventors: Matthias Krull, Harxheim (DE); Werner Reimann, Frankfurt (DE)

(73) Assignee: Clariant Produkte (Deutschland) GmbH, Frankfurt (DE)

( * ) Notice: Subject to any disclaimer, the term of this patent is extended or adjusted under 35 U.S.C. 154(b) by 212 days.

(21) Appl. No.: 11/494,841

(22) Filed: Jul. 28, 2006

(65) Prior Publication Data

US 2007/0022654 A1 Feb. 1, 2007

(30) Foreign Application Priority Data

Jul. 28, 2005 (DE) ..... 10 2005 035 277

(51) Int. Cl.
*C10L 1/18* (2006.01)
*C10L 10/22* (2006.01)

(52) U.S. Cl. ..... 44/351; 44/403; 44/433; 252/500; 252/510; 252/511; 525/25; 525/28; 525/32; 525/38; 528/129; 528/137

(58) Field of Classification Search ..... 44/300, 44/397, 412; 525/25, 28, 32, 38, 46, 501.5; 252/500, 510–511; 528/129, 137
See application file for complete search history.

(56) References Cited

U.S. PATENT DOCUMENTS

| | | | | |
|---|---|---|---|---|
| 3,917,466 | A | 11/1975 | Henry | |
| 4,211,534 | A | 7/1980 | Feldman | |
| 4,356,002 | A | 10/1982 | Knepper | |
| 4,537,601 | A | 8/1985 | Naiman | |
| 4,613,342 | A * | 9/1986 | Dorer et al. | 44/334 |
| 4,670,516 | A | 6/1987 | Sackmann | |
| 4,985,160 | A * | 1/1991 | Henry et al. | 508/470 |
| 5,039,437 | A | 8/1991 | Martella | |
| 5,089,589 | A | 2/1992 | Hesse | |
| 5,186,720 | A | 2/1993 | Feustel | |
| 5,391,632 | A | 2/1995 | Krull | |
| 5,707,946 | A | 1/1998 | Hiebert | |
| 5,766,273 | A | 6/1998 | Dralle-Voss | |
| 5,851,429 | A | 12/1998 | Magyar | |
| 5,998,530 | A | 12/1999 | Krull | |
| 6,232,277 | B1 * | 5/2001 | Ledeore et al. | 508/475 |
| 2001/0013196 | A1 * | 8/2001 | Krull et al. | 44/388 |
| 2001/0048099 | A1 | 12/2001 | Schield | |
| 2004/0065004 | A1 * | 4/2004 | Krull et al. | 44/601 |
| 2005/0000151 | A1 | 1/2005 | Jackson | |
| 2005/0005507 | A1 | 1/2005 | Krull et al. | |
| 2005/0016060 | A1 | 1/2005 | Krull et al. | |
| 2005/0039384 | A1 * | 2/2005 | Gormley | 44/397 |
| 2007/0027040 | A1 | 2/2007 | Krull et al. | |
| 2007/0027041 | A1 | 2/2007 | Krull et al. | |

FOREIGN PATENT DOCUMENTS

| | | | |
|---|---|---|---|
| CA | 2017126 | | 11/1990 |
| EP | 0 061 894 | | 10/1982 |
| EP | 0 857 776 | A1 | 8/1998 |
| EP | 1 500 691 | A2 | 1/2005 |
| EP | 1 640 438 | A1 | 3/2006 |
| WO | WO 03/042336 | A2 | 5/2003 |

OTHER PUBLICATIONS

Hunag, H. et al. (2001). "Melt grafting of a long-chain unsaturated carboxylic acid onto polypropylene." Reactive & Functional Polymers, 50, pp. 49-55.*

Roempp Chemie Lexikon, 9th Ed., (1988-1992) vol. 4, pp. (3351-3354).

"Aviation Fuels Technical Review", Chevron Corporation, Internet Citation, Jan. 1, 2006, 96 pages.

* cited by examiner

*Primary Examiner*—Robert J Hill, Jr.
*Assistant Examiner*—Brian McCaig
(74) *Attorney, Agent, or Firm*—Tod A. Waldrop

(57) ABSTRACT

The invention provides mineral oil distillates having a water content of less than 150 ppm and a conductivity of at least 50 pS/m, which comprise from 0.1 to 200 ppm of at least one alkylphenol-aldehyde resin and from 0.1 to 200 ppm of at least one nitrogen-containing polymer.

17 Claims, No Drawings

MINERAL OILS WITH IMPROVED CONDUCTIVITY AND COLD FLOWABILITY

The present invention relates to the use of alkylphenol-aldehyde resins and nitrogen-containing polymers for improving the conductivity of low-water mineral oil distillates, and to the additized mineral oil distillates.

In the face of increasingly strict environmental legislation, the content of sulfur compounds and aromatic hydrocarbons in mineral oil distillates is having to be lowered ever further. However, in the refinery processes used to produce on-spec mineral oil qualities, other polar and aromatic compounds are simultaneously also removed. Often, the uptake capacity of the oils for water is also reduced. As a side effect, this greatly lowers the electrical conductivity of these mineral oil distillates. As a result of this, electrostatic charges, as occur especially under high flow rates, for example in the course of pumped circulation in pipelines and filters in the refinery, in the distribution chain and in the consumer's equipment, cannot be dissipated. However, such potential differences between the oil and its environment harbor the risk of spark discharge which can lead to self-ignition or explosion of the highly inflammable liquids. Additives which increase the conductivity and facilitate the potential dissipation between the oil and its environment are therefore added to such oils with low electrical conductivity. What is particularly problematic in this context is the increase in the electrical conductivity at low temperatures, since the conductivity of organic liquids decreases with falling temperature and the known additives also show the same temperature dependence. A conductivity of more than 50 pS/m is generally considered to be sufficient for safe handling of mineral oil distillates. Processes for determining the conductivity are described, for example, in DIN 51412-T02-79 and ASTM 2624.

One compound class used for various purposes in mineral oils is that of alkylphenol resins and derivatives thereof, which can be prepared by condensation of phenols bearing alkyl radicals with aldehydes under acidic or basic conditions. For example, alkylphenol resins are used as cold flow improvers, lubricity improvers, oxidation inhibitors, corrosion inhibitors and asphalt dispersants, and alkoxylated alkylphenol resins as demulsifiers in crude oils and middle distillates. In addition, alkylphenol resins are used as stabilizers for jet fuel. Equally, resins of benzoic esters with aldehydes or ketones are used as cold additives for fuel oils.

A further group of mineral oil additives is that of polymers, which comprise structural elements derived from nitrogen-containing monomers and can be added, for example, to fuel oils to improve different properties such as cold flowability, lubricity, and also to improve electrical conductivity.

EP-A-1 088 045 discloses that alkylphenol resins can be used together with oil-soluble polar nitrogen compounds, to improve the cold properties of middle distillates and the lubricity of low-sulfur fuel oils.

EP-A-1 502 938 discloses fuel oils having improved conductivity, which may comprise mixtures of polymeric esters of acrylic acid, methacrylic acid and fumaric acid, which may optionally comprise nitrogen-containing comonomers, with either a polysulfone and a polymeric reaction product of epichlorohydrin and an aliphatic primary monoamine or an N-alkyl-alkylenediamine or, alternatively with an oil-soluble copolymer of alkylvinyl monomer and cationic vinyl monomer. According to paragraphs 17 to 19, these oils may additionally comprise antioxidants, for example BHT.

EP-A-1 274 819 discloses fuel oils with improved conductivity, which comprise mixtures of an oil-soluble copolymer of alkylvinyl monomer and cationic vinyl monomer, a polysulfone and optionally a polyamine or sulfonate salts thereof.

EP-A-0 964 052 discloses copolymers of ethylene with nitrogen-containing comonomers as lubricity improvers or low-sulfur middle distillates.

U.S. Pat. No. 4,356,002 discloses the use of oxyalkylated alkylphenol resins as antistats for hydrocarbons. With amino-bearing copolymers of maleic anhydride and α-olefins, these lead to synergistically improved conductivity. The formulation of additive concentrates from theses two substance classes presents difficulties in that they are barely miscible and thus form multiphasic systems.

Most of the commercially used conductivity improvers comprise metal ions and/or polysulfones as the active component. The latter are copolymers of $SO_2$ and olefins. However, ash-forming and sulfur-containing additives are fundamentally undesired for use in low-sulfur fuels. The activity of the oil-soluble nitrogen compounds known as a further additive component as lubricity improvers is insufficient on its own and becomes, like the combination of these polar oil-soluble nitrogen compounds with oxyalkylated alkylphenol resins according to U.S. Pat. No. 4,356,002 too, ever more unsatisfactory with decreasing aromatics and water content of the oils to be additized. In the case of such oils, though, subsequent addition of water leads only to the dispersion of undissolved water in the oil, which does not contribute to improvement in the electrical conductivity but rather leads to increased corrosion problems and, under cold conditions, harbors the risk of ice formation and resulting blockages of conveying lines and filters.

It is thus an object of the present invention to find an additive, superior in its activity over the prior art, for improving the electrical conductivity of mineral oil distillates with low water content, especially of low-aromatics mineral oil distillates, which additionally ensures safe handling of these oils even at low temperatures. In order to leave behind no residues in the combustion, the additive should combust ashlessly and in particular not comprise any metals. Moreover, it should comprise neither halides nor sulfur compounds.

It has now been found that, surprisingly, the electrical conductivity of low-aromatics mineral oils can be improved significantly by addition of small amounts of phenol resins (constituent I) and nitrogen-containing polymers (constituent II). The conductivity is increased to a significantly greater extent by the combination of these two additive components than would be expected from the effect of the individual substances. In addition, the conductivity remains constant with falling temperature and even rises with falling temperature in many cases. The oils thus additized exhibit a greatly increased conductivity and can therefore be handled substantially more safely especially at low temperatures.

The invention thus provides for the use of compositions comprising at least one alkylphenol-aldehyde resin which contains a structural element of the formula

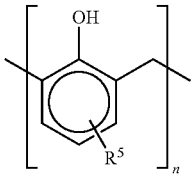

in which $R^5$ is $C_1$-$C_{200}$-alkyl or $C_2$-$C_{200}$-alkenyl, O—$R^6$ or O—C(O)—$R^6$, $R^6$ is $C_1$-$C_{200}$-alkyl or $C_2$-$C_{200}$-alkenyl, and n is from 2 to 100, and, based on the alkylphenol-aldehyde resin or the alkylphenol-aldehyde resins, comprise from 0.1 to 10% by weight of at least one nitrogen-containing polymer, for improving the electrical conductivity of mineral oil distillates having a water content of less than 150 ppm.

The invention further provides for the use of at least one alkylphenol-aldehyde resin (constituent I), which contains a structural element of the formula

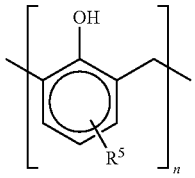

in which $R^5$ is $C_1$-$C_{200}$-alkyl or $C_2$-$C_{200}$-alkenyl, O—$R^6$ or O—C(O)—$R^6$, $R^6$ is $C_1$-$C_{200}$-alkyl or $C_2$-$C_{200}$-alkenyl, and n is from 2 to 100, for improving the electrical conductivity of low-aromatics mineral oil distillates which have a water content of less than 150 ppm, and comprise from 0.1 to 200 ppm of at least one nitrogen-containing polymer (constituent II) in such an amount that the mineral oil distillates have a conductivity of at least 50 pS/m.

The invention further provides a process for improving the electrical conductivity of mineral oil distillates having a water content of less than 150 ppm, by adding to the mineral oil distillates compositions comprising at least one alkylphenol-aldehyde resin, which contains a structural element of the formula

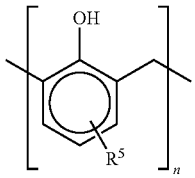

in which $R^5$ is $C_1$-$C_{200}$-alkyl or $C_2$-$C_{200}$-alkenyl, O—$R^6$ or O—C(O)—$R^6$, $R^6$ is $C_1$-$C_{200}$-alkyl or $C_2$-$C_{200}$-alkenyl, and n is from 2 to 100, and, based on the alkylphenol-aldehyde resin, from 0.1 to 10 parts by weight of at least one nitrogen-containing polymer, so that the mineral oil distillates have a conductivity of at least 50 pS/m.

The invention further provides a process for improving the electrical conductivity of mineral oil distillates having a water content of less than 150 ppm, and comprising from 0.1 to 200 ppm of at least one nitrogen-containing polymer by adding to the mineral oil distillates from 0.1 to 200 ppm of at least one alkylphenol-aldehyde resin, which contains a structural element of the formula

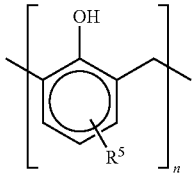

in which $R^5$ is $C_1$-$C_{200}$-alkyl or $C_2$-$C_{200}$-alkenyl, O—$R^6$ or O—C(O)—$R^6$, $R^6$ is $C_1$-$C_{200}$-alkyl or $C_2$-$C_{200}$-alkenyl, and n is from 2 to 100, so that the mineral oil distillates have a conductivity of at least 50 pS/m.

The invention further provides mineral oil distillates which have a water content of less than 150 ppm and a conductivity of at least 50 pS/m, and comprise from 0.1 to 200 ppm of at least one alkylphenol-aldehyde resin, which contains a structural element of the formula

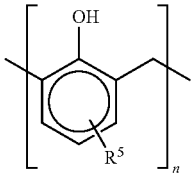

in which $R^5$ is $C_1$-$C_{200}$-alkyl or $C_2$-$C_{200}$-alkenyl, O—$R^6$ or O—C(O)—$R^6$, $R^6$ is $C_1$-$C_{200}$-alkyl or $C_2$-$C_{200}$-alkenyl, and n is from 2 to 100, and from 0.1 to 200 ppm of at least one nitrogen-containing polymer.

The invention further provides additives for mineral oil distillates which have a water content of less than 150 ppm, and comprise at least one alkylphenol-aldehyde resin and at least one nitrogen-containing polymer in a mass ratio of from 99:1 to 1:99.

In the context of the present invention, alkylphenol-aldehyde resins are understood to mean all polymers which are obtainable by condensation of a phenol bearing alkyl radicals with aldehydes or ketones. The alkyl radical can be bonded to the aryl radical of the phenol directly via a C—C bond or else via functional groups such as ethers or esters.

Preference is given to using from 0.2 to 100 ppm and especially from 0.25 to 25 ppm for example from 0.3 to 10 ppm, of at least one alkylphenol-aldehyde resin and from 0.2 to 50 ppm and especially from 0.25 to 25 ppm, for example from 0.3 to 20 ppm, of at least one nitrogen-containing polymer to improve the electrical conductivity. Particular preference is given to using a total of up to 100 ppm, preferably from 0.2 to 70 ppm and especially from 0.3 to 50 ppm of the combination of alkylphenol-aldehyde resin or alkylphenol-aldehyde resins and nitrogen-containing polymer or nitrogen-containing polymers.

The inventive mineral oil distillates preferably comprise from 0.2 to 100 ppm and especially from 0.25 to 25 ppm for example from 0.3 to 10 ppm, of at least one alkylphenol-aldehyde resin and from 0.2 to 50 ppm and especially from 0.25 to 25 ppm, for example from 0.3 to 20 ppm, of at least one nitrogen-containing polymer. The inventive mineral oil distillates more preferably comprise a total of up to 100 ppm, preferably from 0.2 to 70 ppm and especially from 0.3 to 50 ppm of the combination of alkylphenol-aldehyde resin or alkylphenol-aldehyde resins and nitrogen-containing polymer or nitrogen-containing polymers.

Preference is given to using from 0.2 to 100 ppm and especially from 0.25 to 25 ppm, for example from 0.3 to 10 ppm of at least one alkylphenol-aldehyde resin to improve the electrical conductivity of mineral oil distillates which comprise from 0.2 to 50 ppm and especially from 0.25 to 25 ppm, for example from 0.3 to 20 ppm, of at least one nitrogen-containing polymer.

The mass ratio between constituent I and constituent II in the inventive additive for mineral oil distillates is preferably between 50:1 and 1:50, more preferably between 10:1 and 1:10, for example between 4:1 and 1:4.

The inventive mineral oil distillates having improved electrical conductivity have an electrical conductivity of preferably at least 60 pS/m, in particular at least 75 pS/m.

Alkylphenol-aldehyde resins as constituent I are known in principle and are described, for example, in Römpp Chemie Lexikon, 9th edition, Thieme Verlag 1988-92, volume 4, p. 3351 ff. Suitable in accordance with the invention are especially those alkylphenol-aldehyde resins, which derive from alkylphenols having one or two alkyl radicals in the ortho- and/or para-position to the OH group. Particularly preferred starting materials are alkylphenols, which bear, on the aromatic ring, at least two hydrogen atoms capable of condensation with aldehydes, and especially monoalkylated phenols. More preferably, the alkyl radical is in the para-position to the phenolic OH group. The alkyl radicals (for constituent I, this refers generally to hydrocarbon radicals as defined below) may be the same or different in the alkylphenol-aldehyde resins usable in the process according to the invention, they may be saturated or unsaturated and have up to 200, preferably 1-20, in particular 4-16, for example 6-12 carbon atoms; they are preferably n-, iso- and tert-butyl, n- and iso-pentyl, n- and iso-hexyl, n- and iso-octyl, n- and iso-nonyl, n- and iso-decyl, n- and iso-dodecyl, tetradecyl, hexadecyl, octadecyl, tripropenyl, tetrapropenyl, poly(propenyl) and poly(isobutenyl) radicals. These radicals are preferably saturated. In a preferred embodiment, the alkylphenol resins are prepared by using mixtures of alkylphenols with different alkyl radicals. For example, resins based on butylphenol on the one hand and octyl-, nonyl- and/or dodecylphenol on the other in a molar ratio of from 1:10 to 10:1 have been found to be particularly useful.

Suitable alkylphenol resins may also contain structural units of further phenol analogs such as salicylic acid, hydroxybenzoic acid and derivatives thereof such as esters, amides and salts, or consist of them.

Suitable aldehydes for the alkylphenol-aldehyde resins are those having from 1 to 12 carbon atoms and preferably those having from 1 to 4 carbon atoms, for example formaldehyde, acetaldehyde, propionaldehyde, butyraldehyde, 2-ethylhexanal, benzaldehyde, glyoxalic acid and their reactive equivalents such as paraformaldehyde and trioxane. Particular preference is given to formaldehyde in the form of paraformaldehyde and especially formalin.

The molecular weight of the alkylphenol-aldehyde resins determined by means of gel permeation chromatography in THF against poly(ethylene glycol) standards is preferably 400-20 000 g/mol, in particular 800-10 000 g/mol and especially 2000-5000 g/mol. A prerequisite here is that the alkylphenol-aldehyde resins are oil-soluble at least in concentrations relevant to the application of from 0.001 to 1% by weight.

In a preferred embodiment of the invention, the alkylphenol-formaldehyde resins contain oligo- or polymers having a repeat structural unit of the formula

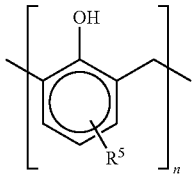

in which $R^5$ is $C_1$-$C_{200}$-alkyl or $C_2$-$C_{200}$-alkenyl, O—$R^6$ or O—C(O)—$R^6$, $R^6$ is $C_1$-$C_{200}$-alkyl or $C_2$-$C_{200}$-alkenyl, and n is from 2 to 100. $R^6$ is preferably $C_1$-$C_{20}$-alkyl or $C_2$-$C_{20}$-alkenyl and especially $C_4$-$C_{16}$-alkyl or $C_2$-$C_{20}$-alkenyl, for example $C_6$-$C_{12}$-alkyl or -alkenyl. More preferably, $R^5$ is $C_1$-$C_{20}$-alkyl or -alkenyl and especially $C_4$-$C_{16}$-alkyl or -alkenyl, for example $C_6$-$C_{12}$-alkyl or -alkenyl. n is preferably from 2 to 50 and especially from 3 to 25, for example from 5 to 15.

For use in middle distillates such as diesel and heating oil, particular preference is given to alkylphenol-aldehyde resins having $C_2$-$C_{40}$-alkyl radicals of the alkylphenol, preferably having $C_4$-$C_{20}$-alkyl radicals, for example $C_6$-$C_{12}$-alkyl radicals. The alkyl radicals may be linear or branched, they are preferably linear. Particularly suitable alkylphenol-aldehyde resins derive from alkylphenols having linear alkyl radicals having 8 and 9 carbon atoms. The mean molecular weight determined by means of GPC is preferably between 700 and 20 000 g/mol, in particular between 1000 and 10 000 g/mol for example between 2000 and 3500 g/mol.

For use in gasoline and jet fuel, particular preference is given to alkylphenol-aldehyde resins, whose alkyl radicals bear from 4 to 200 carbon atoms, preferably from 10 to 180 carbon atoms, and derive from oligomers or polymers of olefins having from 2 to 6 carbon atoms, for example from poly(isobutylene). They are thus preferably branched. The degree of polymerization (n) here is preferably between 2 and 20, more preferably between 3 and 10 alkylphenol units.

These alkylphenol-aldehyde resins are obtainable by known processes, for example by condensation of the appropriate alkylphenols with formaldehyde, i.e. with from 0.5 to 1.5 mol, preferably from 0.8 to 1.2 mol of formaldehyde per mole of alkylphenol. The condensation can be effected without solvent, but is preferably effected in the presence of a water-immiscible or only partly water-miscible inert organic solvent such as mineral oil, alcohols, ethers and the like. Particular preference is given to solvents which can form azeotropes with water. Useful such solvents are especially aromatics such as toluene, xylene, diethylbenzene and relatively high-boiling commercial solvent mixtures such as ®Shellsol AB, and Solvent Naphtha. The condensation is effected preferably between 70 and 200° C., for example between 90 and 160° C. It is typically catalyzed by from 0.05 to 5% by weight of bases or preferably by from 0.05 to 5% by weight of acids. The catalysts used as acidic catalysts are, in addition to carboxylic acids such as acetic acid and oxalic acid, especially strong mineral acids such as hydrochloric acid, phosphoric acid, and sulfuric acid, and also sulfonic acids. Particularly suitable catalysts are sulfonic acids which contain at least one sulfonic acid group and at least one saturated or unsaturated, linear, branched and/or cyclic hydrocarbon radical having from 1 to 40 carbon atoms and preferably having from 3 to 24 carbon atoms. Particular preference is given to aromatic sulfonic acids, especially alkylaromatic monosulfonic acids having one or more $C_1$-$C_{28}$-alkyl radicals and especially those having $C_3$-$C_{22}$-alkyl radicals. Suitable examples are methanesulfonic acid, butanesulfonic acid, benzenesulfonic acid, p-toluenesulfonic acid, xylenesulfonic acid, 2-mesitylenesulfonic acid, 4-ethylbenzene sulfonic acid, isopropylbenzene sulfonic acid, 4-butylbenzene sulfonic acid, 4-octylbenzene sulfonic acid; dodecylbenzene sulfonic acid, didodecylbenzenesulfonic acid, naphthalenesulfonic acid. Mixtures of these sulfonic acids are also suitable. Typically, they remain in the product as such or in neutralized form after the reaction has ended; salts which contain metal ions and thus form ash are typically removed.

Particularly suitable nitrogen-containing polymers are:

a) comb polymers containing units derived from monomers having a $C_4$- to $C_{40}$-alkyl radical and at least one nitrogen-containing comonomer,
b) copolymers of ethylene with ethylenically unsaturated nitrogen-containing comonomers, and c) polymeric polyamines, prepared by condensation of an aliphatic primary monoamine or of an N-alkylalkylenediamine with epichlorohydrin or glycidol.

Comb polymers suitable as constituent IIa) derive especially from oil-soluble esters of ethylenically unsaturated carboxylic acids, oil-soluble vinyl esters and/or oil-soluble vinyl ethers which bear a $C_4$- to $C_{40}$-alkyl radical. Particularly suitable polymers are poly(acrylates), poly(methacrylates), poly(maleinates) and poly(fumarates), which derive from esters of acrylic acid, methacrylic acid, maleic acid and/or fumaric acid with $C_4$-$C_{40}$-alcohols and especially with $C_6$- to $C_{22}$-alcohols. The alkyl radicals are preferably linear or branched; they are preferably saturated. Examples include n-butyl acrylate, 2-ethylhexyl acrylate, lauryl acrylate, stearyl acrylate, n-butyl methacrylate, 2-ethylhexyl methacrylate, lauryl methacrylate, stearyl methacrylate and the like.

A further group of suitable comb polymers IIa) derives from olefins having from 6 to 42 carbon atoms. The olefins are preferably linear. The double bond is preferably terminal as, for example, in 1-decane, 1-dodecane, 1-tetradecane, 1-hexadecane. Likewise preferred are mixtures of different olefins in the $C_{20}$-$C_{24}$, $C_{22}$-$C_{28}$ and $C_{24}$-$C_{30}$ chain length range.

The comb polymers IIa) contain at least one nitrogen-containing comonomer, whose nitrogen is preferably present in the form of an amino, amido, imido or ammonium group and is bonded to the polymer backbone via a hydrocarbon radical. They are preferably amino or ammonium groups which are bonded to the polymer backbone via a $C_2$- to $C_{12}$-alkylene radical which may optionally be interrupted by ester or amide moieties. Ammonium groups include preferably salts of primary, secondary and tertiary amines with mineral acids, organic sulfonic acids and preferably with carboxylic acids. Comonomers bearing quaternary ammonium groups are also suitable.

Examples of suitable comonomers are polymerizable unsaturated basic amines such as allylamine and diallylamine, amino-bearing olefins such as p-(2-diethylaminoethyl)styrene, nitrogen-containing heterocycles with exocyclic double bond such as vinylpyridine and vinylpyrrolidone, esters of ethylenically unsaturated carboxylic acids with amino alcohols, such as N,N-(dimethylamino)ethyl acrylate, N,N-(dimethylamino)ethyl methacrylate or N,N-(dimethylamino)propyl methacrylate, amides of diamines with ethylenically unsaturated carboxylic acids, such as N,N-(dimethylamino)propylmethacrylamide, N-(aminopropyl)morpholine and their quaternized derivates such as N,N,N-(trimethylammonium)ethyl methacrylate methosulfate, N,N,N-(trimethylammonium)propyl methacrylate methosulfate and amides or ethylenically unsaturated dicarboxylic acids with polyamines, which contain from 2 to 5 nitrogen atoms of which preferably only one is present in the form of a primary amino group, such as N,N-dimethylaminopropylamine. Particular preference is given to polymers of $C_8$-$C_{14}$-alkyl methacrylate and N,N-(dimethylamino)propylmethacrylamide or N,N-(dimethylamino)propyl methacrylate, and also copolymers of $C_8$-$C_{14}$-alkylacrylate and N,N,N-(trimethylammonium)propylmethacrylamide methosulfate. Likewise suitable are nitrile-bearing monomers such as acrylonitrile and methacrylonitrile.

The molar ratio between the esters of ethylenically unsaturated carboxylic acids, vinyl esters, vinyl ethers and/or olefins on the one hand and the nitrogen-containing comonomers on the other is preferably between 20:1 and 1:1, for example between 10:1 and 3:1. These copolymers have a nitrogen content of from 0.3 to 5% by weight, for example from 0.5 to 3% by weight.

The comb polymers IIa may also contain up to 20 mol %, for example from 1 to 10%, of further comonomers such as α-olefins having from 4 to 40 carbon atoms, acrylamide, methacrylamide, $C_1$-$C_{20}$-alkylacrylamide and/or $C_1$-$C_{20}$-alkylmethacrylamide.

The comb polymers preferably have molecular weights (Mn) determined by means of gel permeation chromatography in THF against poly(styrene) standards of from 1000 to 100 000 g/mol, preferably from 5000 to 50 000 g/mol.

The comb polymers IIa) are prepared preferably by direct copolymerization of the comonomers. However, they can alternatively also be prepared by polymer-like reaction of copolymers of esters of ethylenically unsaturated carboxylic acids, vinyl esters, vinyl ethers and/or olefins which bear a $C_1$- to $C_{40}$-alkyl radical and ethylenically unsaturated carboxylic acids or their reactive derivatives such as anhydrides, acid halides or esters with lower alcohols having from 1 to 4 carbon atoms with hydroxyamines or polyamines. Suitable hydroxyamines are, for example, N,N-dimethylaminoethanol and N-cocoalkylaminoethanol. Suitable polyamines are, for example, N,N-dimethylaminopropylamine, N-cocoalkylpropylenediamine and N-tallow alkylpropylenediamine. A further preparation variant is the grafting of the nitrogen-containing comonomers to polymers of esters of ethylenically unsaturated carboxylic acids, vinyl esters, vinyl ethers and/or olefins which bear a $C_1$- to $C_{40}$-alkyl radical.

Polymers bearing quaternary ammonium groups may be prepared by copolymerization of the polymerizable quaternary ammonium compounds or by polymer-like reaction of an amino-bearing polymer with alkylating agents such as alkyl halides or sulfuric esters. Particular preference is given to halogen-free alkylating agents, for example dimethyl sulfate.

Examples of particularly preferred nitrogen-containing polymers IIa) are copolymers of N,N,N,-(trimethylammonium)ethyl methacrylate methosulfate and 2-ethylhexyl acrylate, copolymers of dodecyl methacrylate and dimethylaminopropylmethacrylamide, and alternating copolymers of tetradecene and acrylonitrile.

The ethylenically unsaturated nitrogen-containing comonomers which, in addition to ethylene, are part of the inventive polymers IIb) are, preferably, the monomers which are also suitable for the preparation of the comb polymers IIa) and contain a nitrogen bonded to the polymer backbone via a hydrocarbon radical in the form of an amino, amido, imido or ammonium group. Examples include:

alkylamino acrylates or methacrylates, for example aminoethyl acrylate, aminopropyl acrylate, amino-n-butyl acrylate, N-methylaminoethyl acrylate, N,N-dimethylaminoethyl acrylate, N,N-(dimethylamino)propyl acrylate, N,N-(diethylamino)propyl acrylate, N,N,N-(trimethylammonium)ethyl acrylate methosulfate and the corresponding methacrylates, alkylacrylamides and -methacrylamides such as ethylacrylamide, butylacrylamide, N-octylacrylamide, N-propyl.N-methoxyacrylamide, N-acryloylphthalimide, N-acryloylsuccinimide, N-methylolacrylamide and the corresponding methacrylamides, iii) vinylamides for example N-vinyl-N-methylacetamide, N-vinylsuccinimide, iv) aminoalkyl vinyl ethers for example aminopropyl vinyl ether, diethylaminoethyl vinyl ether, dimethylaminopropyl vinyl ether, v) ethylenically unsaturated amines such as allylamine, diallylamine, N-allyl-N-methylamine, and N-allyl-N-ethylamine, vi) heterocycles bearing a vinyl group, for example N-vinylpyrrolidone, methylvinylimidazole, 2-vinylpyridine, 4-vinylpyridine, 2-methyl-5-vinylpyridine, vinylcarbazole, vinylimidazole, N-vinyl-2-piperidone, N-vinylcaprolactam.

Preferred copolymers IIb) contain, in addition to ethylene, from 0.1 to 15 mol %, in particular from 1 to 10 mol %, of one or more of the nitrogen-containing comonomers. In addition, they may also comprise further, for example one, two or three further, ethylenically unsaturated comonomers. Suitable further comonomers are, for example, vinyl esters, acrylic acid, methacrylic acid, acrylic esters, methacrylic esters, vinyl ethers and olefins. Particularly preferred vinyl esters are vinyl acetate, vinyl propionate, vinyl butyrate, vinyl octanoate, vinyl 2-ethylhexanoate, vinyl laurate and vinyl esters of neocarboxylic acids having 8, 9, 10, 11 or 12 carbon atoms. Particularly preferred acrylic and methacrylic esters derive from alcohols having from 1 to 20 carbon atoms, especially having from 1 to 4 carbon atoms, such as methanol, ethanol and propanol. Particularly preferred olefins are those having from 3 to 10 carbon atoms, especially propene, butene, isobutylene, diisobutylene, 4-methylpentene, hexene and norbornene. When the copolymers IIb) contain a further comonomer its molar proportion is preferably up to 15 mol %, in particular from 1 to 12 mol %, for example from 2 to 10 mol %.

The melt viscosity of these copolymers measured at 140° C. is preferably below 10 000 mPas, in particular between 10 and 1000 mPas, for example between 20 and 500 mPas.

The comonomers are copolymerized by known processes (on this subject, cf., for example, Ullmanns Encyclopädie der Technischen Chemie, 4th edition, vol. 19, pages 169 to 178). Suitable polymerizations are in solution, in suspension, in the gas phase and high-pressure bulk polymerization. Preference is given to employing high-pressure bulk polymerization which is carried out at pressures of from 50 to 400 MPa, preferably from 100 to 300 MPa, and temperatures of from 50 to 350° C., preferably from 100 to 300° C. The reaction of the comonomers is initiated by free radical-forming initiators (radical chain starters). This substance class includes, for example, oxygen, hydroperoxides, peroxides and azo compounds, such as cumene hydroperoxide, t-butyl hydroperoxide, dilauroyl peroxide, dibenzoyl peroxide, bis(2-ethylhexyl) peroxidicarbonate, t-butyl permaleate, t-butyl perbenzoate, dicumyl peroxide, t-butyl cumyl peroxide, di-(t-butyl) peroxide, 2,2'-azobis(2-methylpropanonitrile), 2,2'-azobis(2-methylbutyronitrile). The initiators are used individually or as a mixture of two or more substances in amounts of from 0.01 to 20% by weight, preferably from 0.05 to 10% by weight, based on the comonomer mixture.

The desired melt viscosity and hence the molecular weight of the copolymers, for a given composition of the comonomer mixture is established by variation of the reaction parameters, pressure and temperature, and optionally by addition of moderators. Useful moderators have been found to be hydrogen, saturated or unsaturated hydrocarbons, for example propane, propene, aldehydes, e.g. propionaldehyde, n-butyraldehyde or isobutyraldehyde, ketones, e.g. acetone, methyl ethyl ketone, methyl isobutyl ketone, cyclohexanone or alcohols, e.g. butanol. Depending upon the desired viscosity, the moderators are applied in amounts of up to 20% by weight, preferably from 0.05 to 10% by weight, based on the comonomer mixture.

The high-pressure bulk polymerization is carried out batchwise or continuously in known high-pressure reactors, for example autoclaves or tubular reactors; tubular reactors have been found to be particularly useful. Solvents such as aliphatic hydrocarbons or hydrocarbon mixtures, benzene or toluene may be present in the reaction mixture, although the solvent-free procedure has been found to be particularly useful. In a preferred embodiment of the polymerization, the mixture of the comonomers, the initiator and, when used, the moderator, is fed to a tubular reactor via the reactor inlet and via one or more side branches. The comonomer streams may have different compositions (EP-B-0 271 738 and EP-A-0 922 716).

Copolymers IIb) equally suitable in accordance with the invention may be prepared by reacting ethylene copolymers which contain acid groups with compounds bearing amino groups. Ethylene copolymers and ethylene terpolymers suitable for this purpose are, for example, those which contain acrylic acid, methacrylic acid, itaconic acid, fumaric acid, maleic acid or maleic anhydride. To prepare an inventive copolymer IIb), these acid-containing copolymers are reacted by means of the acid groups with alkanolamines such as ethanolamine, propanolamine, diethanolamine, N-ethylethanolamine, N,N-dimethylethanolamine, diglycolamine, 2-amino-2-methylpropanolamine and/or polyamines such as ethylenediamine and dimethylaminopropylamine and/or N-alkylalkylenepolyamines such as N-cocoalkylpropylenediamine or corresponding compounds bearing ammonium groups or mixtures thereof. From 0.1 to 1.2 mol, preferably equimolar amounts, of amine are used per mole of acid.

Nitrogen-containing ethylene copolymers prepared both by direct polymerization and by polymer-like reaction can be converted to quaternary ammonium salts by reacting with alkylating agents such as alkyl halides or sulfuric esters. Particular preference is given to halogen-free alkylating agents, for example dimethyl sulfate.

The polymeric polyamines suitable in accordance with the invention as constituent IIc) are in particular polyamines having 4 or more, preferably 6 or more for example 8 or more nitrogen atoms in the molecule. The nitrogen atoms are part of the main chain. The main polymer chain preferably bears alkyl side chains having 8 and more carbon atoms.

The polymeric polyamines are preferably condensation products of amines and epichlorohydrin or glycidol in a molar ratio of from 1:1 to 1:1.5. Preference is given to polymers based on primary monoamines, especially alkylamines, and also based on N-alkylalkylenediamines, whose alkyl radicals have from 8 to 24 and in particular from 8 to 12 carbon atoms and whose alkylene radical has from 2 to 6 carbon atoms for example N-alkyl-1,3-propylenediamine. The alkyl radicals are preferably linear. The condensation products IIc) preferably have degrees of polymerization of from 2 to 20.

The nitrogen-containing polymers IIa), IIb) and also IIc), in which the nitrogen is present as a basic amino group, are preferably used in the form of salts and especially in the form of sulfonate salts. Preferred sulfonic acids for salt formation are oil-soluble sulfonic acids such as alkanesulfonic acids, arylsulfonic acids and alkylarylsulfonic acids, for example dodecylbenzenesulfonic acid.

For the purpose of simpler handling, the inventive compositions are preferably used in the form of concentrates which comprise from 10 to 90% by weight and preferably from 20 to 60% by weight of solvent. Preferred solvents are relatively high-boiling aliphatic hydrocarbons, aromatic hydrocarbons, alcohols, esters, ethers and mixtures thereof. In the concentrates, the mixing ratio between the inventive alkylphenol-aldehyde resins as constituent I and nitrogen compounds as constituent II may vary depending on the application. Such concentrates preferably contain from 0.1 to 10 parts by weight, preferably from 0.2 to 6 parts by weight of the polar, oil-soluble nitrogen compounds per part by weight of alkylphenol-aldehyde resin.

To further increase the electrical conductivity of mineral oils, the inventive additives may also be used in combination with polysulfones. Suitable polysulfones are obtainable by copolymerization of sulfur dioxide with 1-olefins having from 6 to 20 carbon atoms, for example 1-dodecene. They have molecular weights determined by means of GPC against poly(styrene) standards of from 10 000 to 1 500 000, preferably from 50 000 to 900 000 and in particular from 100 000 to 500 000. The preparation of suitable polysulfones is known, for example from U.S. Pat. No. 3,917,466.

The inventive additive can also be added to mineral oil distillates to improve the cold flowability in combination with further additives, for example ethylene copolymers, paraffin dispersants, comb polymers, polyoxyalkylene compounds and/or olefin copolymers.

In a preferred embodiment, the inventive additives for mineral oil distillates comprise, in addition to constituents I and II, also one or more of constituents III to VII.

For instance, they preferably comprise copolymers of ethylene and olefinically unsaturated compounds as constituent III. Suitable ethylene copolymers are especially those which, in addition to ethylene, contain from 6 to 21 mol %, in particular from 10 to 18 mol % of comonomers.

The olefinically unsaturated compounds are preferably vinyl esters, acrylic esters, methacrylic esters, alkyl vinyl ethers and/or alkenes, and the compounds mentioned may be substituted by hydroxyl groups. One or more of these comonomers may be present in the polymer The vinyl esters are preferably those of the formula 1

$$CH_2{=}CH{-}OCOR^1 \quad (1)$$

where $R^1$ is $C_2$- to $C_{30}$-alkyl, preferably $C_4$- to $C_{16}$-alkyl, especially $C_6$- to $C_{12}$-alkyl. In a further embodiment, the alkyl groups mentioned may be substituted by one or more hydroxyl groups.

In a further preferred embodiment, $R^1$ is a branched alkyl radical or a neoalkyl radical having from 7 to 11 carbon atoms, in particular having 8, 9 or 10 carbon atoms. Particularly preferred vinyl esters derive from secondary and especially tertiary carboxylic acids whose branch is in the alpha-position to the carbonyl group. Suitable vinyl esters include vinyl acetate, vinyl propionate, vinyl butyrate, vinyl isobutyrate, vinyl hexanoate, vinyl heptanoate, vinyl octanoate, vinyl pivalate, vinyl 2-ethylhexanoate, vinyl laurate, vinyl stearate and versatic esters such as vinyl neononanoate, vinyl neodecanoate, vinyl neoundecanoate.

In a further preferred embodiment, these ethylene copolymers contain vinyl acetate and at least one further vinyl ester of the formula 1 where $R^1$ is $C_4$- to $C_{30}$-alkyl, preferably $C_4$- to $C_{16}$-alkyl, especially $C_6$- to $C_{12}$-alkyl.

The acrylic esters are preferably those of the formula 2

$$CH_2{=}CR^2{-}COOR^3 \quad (2)$$

where $R^2$ is hydrogen or methyl and $R^3$ is $C_1$- to $C_{30}$-alkyl, preferably $C_4$- to $C_{16}$-alkyl, especially $C_6$- to $C_{12}$-alkyl. Suitable acrylic esters include, for example, methyl (meth)acrylate, ethyl (meth)acrylate, propyl (meth)acrylate, n- and isobutyl (meth)acrylate, hexyl, octyl, 2-ethylhexyl, decyl, dodecyl, tetradecyl, hexadecyl, octadecyl (meth)acrylate and mixtures of these comonomers. In a further embodiment, the alkyl groups mentioned may be substituted by one or more hydroxyl groups. An example of such an acrylic ester is hydroxyethyl methacrylate.

The alkyl vinyl ethers are preferably compounds of the formula 3

$$CH_2{=}CH{-}OR^4 \quad (3)$$

where $R^4$ is $C_1$- to $C_{30}$-alkyl, preferably $C_4$- to $C_{16}$-alkyl, especially $C_6$- to $C_{12}$-alkyl. Examples include methyl vinyl ether, ethyl vinyl ether, isobutyl vinyl ether. In a further embodiment, the alkyl groups mentioned may be substituted by one or more hydroxyl groups.

The alkenes are preferably monounsaturated hydrocarbons having from 3 to 30 carbon atoms, in particular from 4 to 16 carbon atoms and especially from 5 to 12 carbon atoms. Suitable alkenes include propene, butene, isobutylene, pentene, hexene, 4-methylpentene, octene, diisobutylene and norbornene and derivatives thereof such as methylnorbornene and vinylnorbornene. In a further embodiment, the alkyl groups mentioned may be substituted by one or more hydroxyl groups.

Particular preference is given to terpolymers, which, apart from ethylene, contain from 3.5 to 20 mol %, in particular from 8 to 15 mol % of vinyl acetate and from 0.1 to 12 mol %, in particular from 0.2 to 5 mol % of at least one relatively long-chain and preferably branched vinyl ester for example vinyl 2-ethylhexanoate, vinyl neononanoate or vinyl neodecanoate, the total comonomer content being between 8 and 21 mol %, preferably between 12 and 18 mol %. Further particularly preferred copolymers contain, in addition to ethylene and from 8 to 18 mol % of vinyl esters, also from 0.5 to 10 mol % of olefins such as propene, butene, isobutylene, hexene, 4-methylpentene, octene, diisobutylene and/or norbornene.

These ethylene co- and terpolymers preferably have melt viscosities at 140° C. of from 20 to 10 000 mPas, in particular from 30 to 5000 mPas, especially from 50 to 2000 mPas. The degrees of branching determined by means of $^1$H-NMR spectroscopy are preferably between 1 and 9 $CH_3$/100 $CH_2$ groups, in particular between 2 and 6 $CH_3$/100 $CH_2$ groups, which do not stem from the comonomers.

Preference is given to using mixtures of two or more of the abovementioned ethylene copolymers. More preferably, the parent polymers of the mixtures differ in at least one characteristic. For example, they may contain different comonomers, have different comonomer contents, molecular weights and/or degrees of branching.

The mixing ratio between the inventive additives and ethylene copolymers as constituent III may, depending on the application, vary within wide limits, the ethylene copolymers III often constituting the greater proportion. Such additive mixtures preferably contain from 2 to 70% by weight, preferably from 5 to 50% by weight of the inventive additive combination of I and II, and from 30 to 98% by weight, preferably from 50 to 95% by weight of ethylene copolymers.

The paraffin dispersants suitable as a further component in accordance with the invention (constituent IV) are preferably reaction products of fatty amines with compounds which contain at least one acyl group. The preferred amines are compounds of the formula $NR^6R^7R^8$ where $R^6$, $R^7$ and $R^8$ may be the same or different, and at least one of these groups is $C_8$-$C_{36}$-alkyl, $C_6$-$C_{36}$-cycloalkyl or $C_8$-$C_{36}$-alkenyl, in particular $C_{12}$-$C_{24}$-alkyl, $C_{12}$-$C_{24}$-alkenyl or cyclohexyl, and the remaining groups are either hydrogen, $C_1$-$C_{36}$-alkyl, $C_2$-$C_{36}$-alkenyl, cyclohexyl, or a group of the formulae $-(A-O)_x-E$ or $-(CH_2)_n-NYZ$, where A is an ethyl or propyl group, x is from 1 to 50, E=H, $C_1$-$C_{30}$-alkyl, $C_5$-$C_{12}$-cycloalkyl or $C_6$-$C_{30}$-aryl, and n=2, 3 or 4, and Y and Z are each independently H, $C_1$-$C_{30}$-alkyl or —(A—O)$_x$. The alkyl and alkenyl radicals may each be linear or branched and contain up to two double bonds. They are preferably linear and substantially saturated, i.e. they have iodine numbers of less than 75 g of $I_2$/g, preferably less than 60 g of $I_2$/g and in particular between 1 and 10 g of $I_2$/g. Particular preference is given to secondary fatty amines in which two of the $R^6$, $R^7$ and $R^8$ groups are each $C_8$-$C_{36}$-alkyl, $C_6$-$C_{36}$-cycloalkyl, $C_8$-$C_{36}$-alkenyl, in particular $C_{12}$-$C_{24}$-alkyl, $C_{12}$-$C_{24}$-alkenyl or cyclohexyl. Suitable fatty amines are, for example, octylamine, decylamine, dodecylamine, tetradecylamine, hexadecylamine, octadecylamine, eicosylamine, behenylamine, didecylamine, didodecylamine, ditetradecylamine, dihexadecylamine, dioctadecylamine, dieicosylamine, dibehenylamine and mixtures thereof. The amines especially contain chain cuts based on natural raw materials, for example coconut fatty amine, tallow fatty amine, hydrogenated tallow fatty amine, dicoconut fatty amine, ditallow fatty amine and di(hydrogenated tallow fatty amine). Particularly preferred amine derivatives are amine salts, imides and/or amides, for example amide-ammonium salts of secondary fatty amines, in particular of dicoconut fatty amine, ditallow fatty amine and distearylamine. Particularly preferred paraffin dispersants as constituent II contain at least one acyl group converted to an ammonium salt. They especially contain at least two, for example at least three or at least four, and, in the case of polymeric paraffin dispersants, even five and more ammonium groups.

Acyl group refers here to a functional group of the following formula:

>C=O

Carbonyl compounds suitable for the reaction with amines are either monomeric or polymeric compounds having one or more carboxyl groups. Preference is given to those monomeric carbonyl compounds having 2, 3 or 4 carbonyl groups. They may also contain heteroatoms such as oxygen, sulfur and nitrogen. Suitable carboxylic acids are, for example, maleic acid, fumaric acid, crotonic acid, itaconic acid, succinic acid, $C_1$-$C_{40}$-alkenylsuccinic acid, adipic acid, glutaric acid, sebacic acid and malonic acid, and also benzoic acid, phthalic acid, trimellitic acid and pyromellitic acid, nitrilotriacetic acid, ethylenediaminetetraacetic acid and their reactive derivatives, for example esters, anhydrides and acid halides. Useful polymeric carbonyl compounds have been found to be in particular copolymers of ethylenically unsaturated acids, for example acrylic acid, methacrylic acid, maleic acid, fumaric acid and itaconic acid; particular preference is given to copolymers of maleic anhydride. Suitable comonomers are those which confer oil solubility on the copolymer. Oil-soluble means here that the copolymer, after reaction with the fatty amine, dissolves without residue in the mineral oil distillate to be additized in practically relevant dosages. Suitable comonomers are, for example, olefins, alkyl esters of acrylic acid and methacrylic acid, alkyl vinyl esters, alkyl vinyl ethers having from 2 to 75, preferably from 4 to 40 and in particular from 8 to 20, carbon atoms in the alkyl radical. In the case of olefins, the carbon number is based on the alkyl radical attached to the double bond. Particularly suitable comonomers are olefins with terminal double bonds. The molecular weights of the polymeric carbonyl compounds are preferably between 400 and 20 000, more preferably between 500 and 10 000, for example between 1000 and 5000.

It has been found that paraffin dispersants which are obtained by reaction of aliphatic or aromatic amines, preferably long-chain aliphatic amines, with aliphatic or aromatic mono-, di-, tri- or tetracarboxylic acids or their anhydrides are particularly useful (cf. U.S. Pat. No. 4,211,534). Equally suitable as paraffin dispersants are amides and ammonium salts of aminoalkylenepolycarboxylic acids such as nitrilotriacetic acid or ethylenediaminetetraacetic acid with secondary amines (cf. EP 0 398 101). Other paraffin dispersants are copolymers of maleic anhydride and α,β-unsaturated compounds which may optionally be reacted with primary monoalkylamines and/or aliphatic alcohols (cf. EP-A-0 154 177, EP 0 777 712), the reaction products of alkenyl-spirobislactones with amines (cf. EP-A-0 413 279 B1) and, according to EP-A-0 606 055 A2, reaction products of terpolymers based on α,β-unsaturated dicarboxylic anhydrides, α,β-unsaturated compounds and polyoxyalkylene ethers of lower unsaturated alcohols.

The mixing ratio between the inventive additives and paraffin dispersants as constituent IV may vary depending upon the application. Such additive mixtures preferably contain from 10 to 90% by weight, preferably from 20 to 80% by weight, of the inventive additive combination of I and II, and from 10 to 90% by weight, preferably from 20 to 80% by weight, of paraffin dispersant.

Suitable comb polymers (constituent V) may be described, for example, by the formula

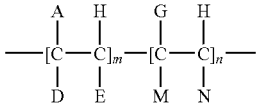

In this formula

A is R', COOR', OCOR', R"—COOR', OR';

D is H, $CH_3$, A or R";

E is H, A;

G is H, R", R"—COOR', an aryl radical or a heterocyclic radical;

M is H, COOR", OCOR", OR", COOH;

N is H, R", COOR", OCOR, an aryl radical;

R' is a hydrocarbon chain having from 8 to 50 carbon atoms;

R" is a hydrocarbon chain having from 1 to 10 carbon atoms;

m is between 0.4 and 1.0; and n is between 0 and 0.6.

Suitable comb polymers are, for example copolymers of ethylenically unsaturated dicarboxylic acids such as maleic acid or fumaric acid with other ethylenically unsaturated monomers such as olefins or vinyl esters, for example vinyl acetate. Particularly suitable olefins are α-olefins having from 10 to 24 carbon atoms, for example 1-decene, 1-dodecene, 1-tetradecene, 1-hexadecene, 1-octadecene and mixtures thereof. Also suitable as comonomers are longer-chain olefins based on oligomerized $C_2$-$C_6$-olefins, for example poly(isobutylene), having a high content of terminal double bonds. Typically, these copolymers are esterified to an extent of at least 50% with alcohols having from 10 to 22 carbon atoms. Suitable alcohols include n-decen-1-ol, n-dodecan-1-ol, n-tetradecan-1-ol, n-hexadecan-1-ol, n-octadecan-1-ol, n-eicosan-1-ol and mixtures thereof. Particular preference is given to mixtures of n-tetradecan-1-ol and n-hexadecan-1-ol. Likewise suitable as comb polymers are poly(alkyl acrylates), poly(alkyl methacrylates) and poly(alkyl vinyl ethers), which derive from alcohols having 12 to 20 carbon atoms and poly(vinyl esters), which derive from fatty acids having from 12 to 20 carbon atoms.

Polyoxyalkylene compounds suitable as a further component (constituent VI) are, for example, esters, ethers and ethers/esters of polyols, which bear at least one alkyl radical having from 12 to 30 carbon atoms. When the alkyl groups stem from an acid, the remainder stems from a polyhydric alcohol; when the alkyl radicals come from a fatty alcohol, the remainder of the compound stems from a polyacid.

Suitable polyols are polyethylene glycols, polypropylene glycols, polybutylene glycols and copolymers thereof having a molecular weight of from approx. 100 to approx. 5000, preferably from 200 to 2000. Also suitable are alkoxylates of polyols, for example of glycerol, trimethylol-propane, pentaerythritol, neopentyl glycol, and the oligomers which are obtainable therefrom by condensation and have from 2 to 10 monomer units, for example polyglycerol. Preferred alkoxylates are those having from 1 to 100 mol, in particular from 5 to 50 mol, of ethylene oxide, propylene oxide and/or butylene oxide per mole of polyol. Esters are particularly preferred.

Fatty acids having from 12 to 26 carbon atoms are preferred for the reaction with the polyols to form the ester additives, and particular preference is given to using $C_{18}$- to $C_{24}$-fatty acids, especially stearic and behenic acid. The esters may also be prepared by esterifying polyoxyalkylated alcohols. Preference is given to fully esterified polyoxyalkylated polyols having molecular weights of from 150 to 2000, preferably from 200 to 600. Particularly suitable are PEG-600 dibehenate and glycerol ethylene glycol tribehenate.

Suitable olefin copolymers (constituent VII) as further constituent of the additive according to the invention may derive directly from monoethylenically unsaturated monomers, or may be prepared indirectly by hydrogenation of polymers which derive from polyunsaturated monomers such as isoprene or butadiene. Preferred copolymers contain, in addition to ethylene, structural units which derive from α-olefins having from 3 to 24 carbon atoms and have molecular weights of up to 120 000 g/mol. Preferred α-olefins are propylene, butene, isobutene, n-hexene, isohexene, n-octene, isooctene, n-decene, isodecene. The comonomer content of α-olefins having 3 to 24 carbon atoms is preferably between 15 and 50 mol %, more preferably between 20 and 35 mol % and especially between 30 and 45 mol %. These copolymers may also contain small amounts, for example up to 10 mol %, of further comonomers, for example nonterminal olefins or nonconjugated olefins. Preference is given to ethylene-propylene copolymers. The olefin copolymers may be prepared by known methods, for example by means of Ziegler or metallocene catalysts.

Further suitable olefin copolymers are block copolymers which contain blocks composed of olefinically unsaturated aromatic monomers A and blocks composed of hydrogenated polyolefins B. Particularly suitable block copolymers have the structure $(AB)_nA$ and $(AB)_m$, where n is between 1 and 10 and m is between 2 and 10.

The mixing ratio between the inventive additive combinations composed of I and II and the further constituents V, VI and VII is generally in each case between 1:10 and 10:1, preferably in each case between 1:5 and 5:1.

The additives may be used alone or else together with other additives, for example with other pour point depressants or dewaxing assistants, with antioxidants, cetane number improvers, dehazers, demulsifiers, detergents, dispersants, antifoams, dyes, corrosion inhibitors, lubricity additives, sludge inhibitors, odorants and/or additives for lowering the cloud point.

The inventive additives increase the conductivity of mineral oil distillates such as gasoline, kerosene, jet fuel, diesel and heating oils, and they are advantageous especially in oils with low aromatics content of less than 21% by weight, in particular less than 19% by weight, especially less than 18% by weight, for example less than 17% by weight. Since they simultaneously improve cold flow properties, especially of mineral oil distillates such as kerosene, jet fuel, diesel and heating oil, their use allows a distinct saving in the overall additization of the oils, since no additional conductivity improvers have to be added. Furthermore, in sectors or at times in which no cold additives have been used to date owing to climatic conditions, for example cloud point and/or CFPP of the oils to be additized can be set higher by admixing of paraffin-rich, less expensive mineral oil fractions which improves the economic viability of the refinery. The inventive additives additionally do not comprise any metals which might lead to ash upon combustion and hence deposits in the combustion chamber or exhaust gas system and particle pollution of the environment.

At the same time, the conductivity of the oils additized in accordance with the invention does not decrease with falling temperature and, in many cases, a rise, unknown of prior art additives, in the conductivity with falling temperature was observed so that safe handling is ensured even at low ambient temperatures. A further advantage of the inventive additives is the retention of the electrical conductivity even over prolonged storage, i.e. for several weeks, of the additized oils. Furthermore, there are no incompatibilities between constituents I and II within the range of the mixing ratios suitable in accordance with the invention, so that, unlike the additives of U.S. Pat. No. 4,356,002 they can be formulated as concentrates without any problems.

They are particularly suitable for the improvement of the electrostatic properties of mineral oil distillates such as jet fuel, gasoline, kerosene, diesel and heating oil which have been subjected to refining under hydrogenating conditions for the purpose of lowering the sulfur content and therefore comprise only small proportions of polyaromatic and polar compounds. The inventive additives are particularly advantageous in mineral oil distillates which contain less than 350 ppm of sulfur, more preferably less than 100 ppm of sulfur, in particular less than 50 ppm of sulfur and, in special cases, less than 10 ppm of sulfur. The water content of such oils is below 150 ppm, in some cases below 100 ppm for example below 80 ppm. The electrical conductivity of such oils is typically below 10 pS/m and often even below 5 pS/m.

Particularly preferred mineral oil distillates are middle distillates. Middle distillates refer in particular to those mineral oils which are obtained by distillation of crude oil and boil in the range from 120 to 450° C., for example kerosene, jet fuel, diesel and heating oil. Their preferred sulfur, aromatics and water contents are as already specified above. The inventive compositions are particularly advantageous in those middle distillates which have 90% distillation points below 360° C., in particular 350° C. and in special cases below 340° C. Aromatic compounds are understood to mean the totality of mono-, di- and polycyclic aromatic compounds, as determinable by means of HPLC according to DIN EN 12916 (2001 edition). The middle distillates can also comprise minor amounts, for example up to 40% by volume, preferably from 1 to 20% by volume, especially from 2 to 15% by volume, for example from 3 to 10% by volume, of the oils of animal and/or vegetable origin described in detail below, for example fatty acid methyl esters.

The inventive compositions are likewise suitable for improving the electrostatic properties of fuels based on renewable raw materials (biofuels). Biofuels are understood to mean oils which are obtained from animal and preferably from vegetable material or both, and also derivatives thereof which can be used as fuel and especially as diesel or heating oil. They are especially triglycerides of fatty acids having from 10 to 24 carbon atoms, and also the fatty acid esters obtainable from them by transesterification of lower alcohols such as methanol or ethanol.

Examples of suitable biofuels are rapeseed oil, coriander oil, soya oil, cottonseed oil, sunflower oil, castor oil, olive oil, peanut oil, corn oil, almond oil, palm kernel oil, coconut oil, mustardseed oil, bovine tallow, bone oil, fish oils and used cooking oils. Further examples include oils which derive from wheat, jute, sesame, shea tree nut, arachis oil and linseed oil. The fatty acid alkyl esters also referred to as biodiesel may be derived from these oils by processes known in the prior art. Preference is given to rapeseed oil, which is a mixture of fatty acids esterified with glycerol, since it is obtainable in large amounts and is obtainable in a simple manner by extractive pressing of rapeseeds. In addition, preference is given to the likewise widely available oils of sunflowers and soya, and also to their mixtures with rapeseed oil.

Particularly suitable as biofuels are lower alkyl esters of fatty acids. Useful here are, for example, commercial mixtures of the ethyl, propyl, butyl and especially methyl esters of fatty acids having from 14 to 22 carbon atoms, for example of lauric acid, myristic acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid or erucic acid. Preferred esters have an iodine number of from 50 to 150 and in particular from 90 to 125. Mixtures having particularly advantageous properties are those which comprise mainly, i.e. to an extent of at least 50% by weight, methyl esters of fatty acids having from 16 to 22 carbon atoms and 1, 2 or 3 double bonds. The preferred lower alkyl esters of fatty acids are the methyl esters of oleic acid, linoleic acid, linolenic acid and erucic acid.

The inventive additives are equally suitable for improving the electrostatic properties of turbine fuels. These are fuels which boil in the temperature range from about 65° C. to about 330° C. and are marketed, for example, under the designations JP-4, JP-5, JP-7, JP-8, Jet A and Jet A-1. JP-4 and JP-5 are specified in the U.S. Military Specification MIL-T-5624-N and JP-8 in the U.S. Military Specification MIL-T-83133-D; Jet A, Jet A-1 and Jet B are specified in ASTM D1655.

The inventive additives are equally suitable for improving the electrical conductivity of hydrocarbons which are used as a solvent, for example, in textile cleaning or for the production of paints and coatings.

EXAMPLES

Table 1

Characterization of Test Oils

The test oils employed were oils from European refineries. The CFPP value was determined to EN 116 and the cloud point to ISO 3015. The aromatic hydrocarbon groups were determined to DIN EN 12916 (November 2001 edition)

| | Test oil 1 | Test oil 2 | Test oil 3 (Comp.) |
|---|---|---|---|
| Distillation | | | |
| IBP [° C.] | 212 | 188 | 160 |
| 20% [° C.] | 244 | 249 | 229 |
| 90% [° C.] | 322 | 336 | 339 |
| FBP [° C.] | 342 | 361 | 371 |
| Cloud point [° C.] | −8.8 | −12.5 | 4.6 |
| Density @ 15° C. [g/cm$^3$] | 0.8302 | 0.8264 | 0.8410 |
| Water content @ 20° C. | 25 | 35 | 185 |
| Sulfur content [ppm] | 4 | 6 | 173 |
| Electr. conductivity @ 25° C. [pS/m] | 0 | 1 | 9 |
| Aromatics content | 14.8 | 16.9 | 29.9 |
| of which mono | 14.5 | 14.4 | 24.1 |
| di | 0.3 | 2.4 | 5.3 |
| poly | <0.1 | 0.1 | 0.5 |

The following additives were used:

(A) Characterization of the Alkylphenol Resins Used

A1 Acid-catalyzed nonylphenol-formaldehyde resin (Mw 1300 g/mol)

A2 Acid-catalyzed nonylphenol-formaldehyde resin (Mw 2200 g/mol)

A3 Acid-catalyzed dodecylphenol-formaldehyde resin (Mw 2600 g/mol)

A4 Alkali-catalyzed dodecylphenol-formaldehyde resin (Mw 2450 g/mol)

A5 Alkylphenol-formaldehyde resin prepared under acid catalysis from equimolar proportions of nonylphenol and butylphenol (Mw 2900 g/mol)

A6 Nonylphenol resin alkoxylated with 5 mol of ethylene oxide per phenolic OH group as per A2 (comparison).

The molecular weights were determined by means of gel permeation chromatography in THF against poly(ethylene glycol) standards. The resins A1) to A4) were used at 50% dilutions in Solvent Naphtha, a commercial mixture of high-boiling aromatic hydrocarbons (B) Characterization of Nitrogen Compounds B Used B1 Copolymer of N,N,N-(trimethylammonium)ethyl methacrylate and 2-ethylhexyl acrylate in a molar ratio of 1:4 according to EP 0909305, 20% in relatively high-boiling aromatic solvent.

B2 Terpolymer of ethylene, 17% by weight of vinyl acetate and 8% by weight 1-vinyl-2-pyrrolidone with a melt viscosity of 170 mPas at 140° C., 50% in relatively high-boiling aromatic solvent.

B3 Dimethyl sulfate-quaternized terpolymer of ethylene, 14% by weight of vinyl propionate and 10% by weight of dimethylaminoethyl methacrylate with a melt viscosity of 220 mPas at 140° C., 50% in relatively high-boiling aromatic solvent.

B4 Copolymer of N-tallow alkyl of 1,3-propylenediamine and epichlorohydrin, 30% in aromatic solvent.

Improvement of the Electrical Conductivity of Middle Distillates

For conductivity measurements, the additives with the concentrations specified in each case were dissolved in 250 ml of test oil 1 with shaking. A Maihak SLA 900 automatic conductivity meter was used to determine the electrical conductivity therein to DIN 51412-T02-79. The unit for the electrical conductivity is picosiemens/m (pS/m). For jet fuel, a conductivity of at least 50 pS/m is generally specified. The dosages specified are each based on the amounts of active substance used.

TABLE 2

Electrical conductivity in test oil 1

| Ex. No. | Additive A dosage | | Additive B dosage | | Conductivity [pS/m] @ 22° C. | @ 10° C. |
|---|---|---|---|---|---|---|
| 1 (comp.) | 25 ppm | A1 | — | — | 3 | 2 |
| 2 (comp.) | 50 ppm | A1 | — | — | 3 | 2 |
| 3 (comp.) | 10 ppm | A2 | — | — | 1 | 1 |
| 4 (comp.) | 25 ppm | A2 | — | — | 3 | 1 |
| 5 (comp.) | 50 ppm | A2 | — | — | 4 | 2 |
| 6 (comp.) | 50 ppm | A3 | — | — | 4 | 3 |
| 7 (comp.) | 50 ppm | A5 | — | — | 3 | 2 |
| 8 (comp.) | 25 ppm | A6 | — | — | 3 | 1 |
| 9 (comp.) | — | — | 10 ppm | B1 | 9 | 7 |
| 10 (comp.) | — | — | 25 ppm | B1 | 25 | 21 |
| 11 (comp.) | — | — | 10 ppm | B2 | 5 | 3 |
| 12 (comp.) | — | — | 25 ppm | B2 | 9 | 6 |
| 13 (comp.) | — | — | 10 ppm | B3 | 7 | 6 |
| 14 (comp.) | — | — | 25 ppm | B3 | 19 | 16 |
| 15 (comp.) | — | — | 10 ppm | B4 | 8 | 4 |
| 16 (comp.) | — | — | 25 ppm | B4 | 22 | 18 |
| 17 (comp.) | — | — | 50 ppm | B4 | 47 | 40 |
| 18 | 4 ppm | A1 | 8 ppm | B1 | 77 | 92 |
| 19 | 10 ppm | A1 | 10 ppm | B1 | 117 | 136 |
| 20 | 5 ppm | A2 | 10 ppm | B4 | 98 | 115 |
| 21 | 16 ppm | A2 | 8 ppm | B4 | 242 | 267 |
| 22 | 8 ppm | A2 | 16 ppm | B4 | 270 | 312 |
| 23 | 25 ppm | A2 | 15 ppm | B4 | 649 | 678 |
| 24 | 4 ppm | A2 | 8 ppm | B2 | 84 | 98 |
| 25 | 4 ppm | A2 | 8 ppm | B3 | 102 | 124 |
| 26 | 8 ppm | A2 | 16 ppm | B3 | 215 | 234 |
| 27 | 5 ppm | A3 | 10 ppm | B3 | 95 | 103 |
| 28 | 10 ppm | A3 | 10 ppm | B3 | 165 | 185 |
| 29 | 5 ppm | A5 | 15 ppm | B3 | 193 | 236 |
| 30 (comp.) | 10 ppm | A6 | 10 ppm | B3 | 44 | 38 |
| 31 (comp.) | 8 ppm | A6 | 16 ppm | B4 | 36 | 25 |

TABLE 3

Electrical conductivity in test oil 2

| Ex. No. | Additive A dosage | | Additive B dosage | | Conductivity [pS/m] @ 25° C. | @ 10° C. |
|---|---|---|---|---|---|---|
| 32 (comp.) | 25 ppm | A1 | — | — | 1 | 0 |
| 33 (comp.) | 10 ppm | A2 | — | — | 2 | 0 |
| 34 (comp.) | 25 ppm | A2 | — | — | 4 | 2 |
| 35 | 25 ppm | A4 | — | — | 5 | 3 |
| 36 (comp.) | 25 ppm | A6 | — | — | 2 | 1 |
| 37 (comp.) | — | — | 10 ppm | B1 | 5 | 3 |
| 38 (comp.) | — | — | 20 ppm | B1 | 12 | 10 |
| 39 (comp.) | — | — | 10 ppm | B2 | 4 | 2 |
| 40 (comp.) | — | — | 20 ppm | B2 | 8 | 7 |
| 41 (comp.) | — | — | 20 ppm | B3 | 14 | 12 |
| 42 (comp.) | — | — | 20 ppm | B4 | 16 | 13 |
| 43 | 8 ppm | A1 | 8 ppm | B1 | 94 | 106 |
| 44 | 8 ppm | A1 | 8 ppm | B2 | 114 | 128 |
| 45 | 4 ppm | A2 | 8 ppm | B2 | 122 | 136 |
| 46 | 8 ppm | A2 | 4 ppm | B3 | 118 | 128 |
| 47 | 4 ppm | A4 | 12 ppm | B3 | 187 | 205 |
| 48 | 3 ppm | A4 | 7 ppm | B4 | 167 | 178 |
| 49 | 10 ppm | A4 | 3 ppm | B4 | 102 | 110 |
| 50 (comp.) | 10 ppm | A6 | 10 ppm | B2 | 56 | 47 |
| 51 (comp.) | 5 ppm | A6 | 10 ppm | B3 | 48 | 43 |

TABLE 4

Electrical conductivity in test oil 3 (comparison)

| Ex. No. | Additive A dosage | | Additive B dosage | | Conductivity [pS/m] @ 25° C. | @ 10° C. |
|---|---|---|---|---|---|---|
| 52 | 10 ppm | A2 | — | — | 19 | 12 |
| 53 | 10 ppm | A6 | — | — | 25 | 18 |
| 54 | — | — | 5 ppm | B1 | 60 | 35 |
| 55 | — | — | 5 ppm | B4 | 53 | 37 |
| 56 | 10 ppm | A2 | 5 ppm | B1 | 152 | 123 |
| 57 | 10 ppm | A2 | 5 ppm | B4 | 176 | 140 |
| 58 | 10 ppm | A6 | 5 ppm | B1 | 197 | 139 |
| 59 | 10 ppm | A6 | 5 ppm | B4 | 223 | 160 |

The examples show that the inventive compositions have a marked synergistic effect compared to the individual components. In addition, they show that the inventive compositions increase the electrical conductivity, especially of low-aromatics fuel oils with low water content, to a greater extent than the known prior art additives. The conductivity of the mineral oil distillates additized in accordance with the invention rises with falling temperature. Since the additives used additionally also improve further properties of middle distillates, for example paraffin dispersancy and lubricity, comparable conductivity can be achieved with lower additive dosage of conventional additives. A further advantage of the invention is that the inventive additives, in addition to the improvement in the conductivity, simultaneously improve the cold properties, which allows the manufacturer of the fuel oil to process a higher proportion of paraffin-rich distillation cuts which are problematic under cold conditions.

What is claimed is:

1. A mineral oil distillate composition having a water content of less than 150 ppm and a conductivity of at least 50 pS/m, which comprises mineral oil distillate, from 0.1 to 200 ppm of at least one alkylphenol-aldehyde resin and from 0.1 to 200 ppm of at least one nitrogen-containing polymer selected from the group consisting of a) a copolymer prepared by direct copolymerization of at least one nitrogen-containing comonomer with a further comonomer selected from the group consisting of an oil soluble ester of an ethylenically unsaturated carboxylic acid, an oil soluble vinyl ester, an oil soluble vinyl ether which bears a $C_4$- to $C_{40}$-alkyl radical or an olefin having from 6 to 42 carbon atoms, b) a copolymer of ethylene with an ethylenically unsaturated nitrogen-containing comonomer, and c) a polymeric polyamine, prepared by condensation of an aliphatic primary monoamine or of an N-alkylalkylenediamine with epichlorohydrin or glycidol.

2. The mineral oil distillate as claimed in claim 1, in which the aldehyde used for the condensation of the at least one alkylphenol-aldehyde resin comprises from 1 to 12 carbon atoms.

3. The mineral oil distillate as claimed in claim 1, in which the alkyl group of the at least one alkylphenol-aldehyde resin comprises from 1 to 200 carbon atoms.

4. The mineral oil distillate of claim 1, wherein the at least one alkylphenol-aldehyde resin has a molecular weight of from 400 to 20 000 g/mol.

5. The mineral oil distillate of claim 1, in which the at least one alkylphenol-aldehyde resin comprises a repeat structural unit of the formula

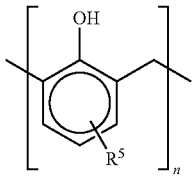

in which $R^5$ is $C_1$-$C_{200}$-alkyl or $C_2$-$C_{200}$-alkenyl, or O—$R^6$ or O—C(O)—$R^6$, $R^6$ is $C_1$-$C_{200}$-alkyl or $C_2$-$C_{200}$-alkenyl, and n is from 2 to 100.

6. The mineral oil distillate as claimed in claim 1, in which the at least one nitrogen-containing polymer, in addition to ethylene, contains from 0.1 to 15 mol % of ethylenically unsaturated nitrogen-containing comonomer selected from the group consisting of alkylaminoacrylates, alkylaminomethacrylates,
alkylacrylamides, alkylmethacrylamides,
vinylamides,
aminoalkyl vinyl ethers,
ethylenically unsaturated amines,
heterocycles bearing a vinyl group, and mixtures thereof.

7. The mineral oil distillate as claimed in claim 1, in which the at least one nitrogen-containing polymer is a polyamine being a condensation product of a primary alkylamine having an alkyl radical of from 8 to 24 carbon atoms or N-alkylalkylenediamine having an alkylene radical having from 2 to 6 carbon atoms, and epichlorohydrin or glycidol in molar ratio of from 1:1 to 1:1.5 with degrees of condensation of from 2 to 20.

8. The mineral oil distillate of claim 1, further comprising a copolymer of ethylene and from 6 to 21 mol % of a compound selected from the group consisting of vinyl esters, acrylic esters, methacrylic esters, alkyl vinyl ethers, alkenes, and mixtures thereof.

9. The mineral oil distillate of claim 1, which additionally comprises comb polymers of the formula

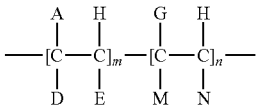

in which

A is R', COOR', OCOR', R"—COOR', OR';
D is H, $CH_3$, A or R";
E is H, A;
G is H, R", R"—COOR', an aryl radical or a heterocyclic radical;
M is H, COOR", OCOR", OR", COOH;
N is H, R", COOR", OCOR", an aryl radical;
R' is a hydrocarbon chain having from 8 to 50 carbon atoms;
R" is a hydrocarbon chain having from 1 to 10 carbon atoms;
m is between 0.4 and 1.0; and
n is between 0 and 0.6.

10. The mineral oil distillate of claim 1, which additionally comprises a polyoxyalkylene compound selected from the group consisting of an ester, an ether, an ether/ester, and mixtures thereof, said compound having at least one alkyl radical having 12 to 30 carbon atoms.

11. The mineral oil distillate of claim 1, further comprising a copolymer which, in addition to structural units of ethylene, contain structural units, which derive from α-olefins having from 3 to 24 carbon atoms, said copolymer having a molecular weight of up to 120 000 g/mol.

12. The mineral oil distillate of claim 1, further comprising a polysulfone which derive from olefins having from 6 to 20 carbon atoms.

13. The mineral oil distillate of claim 1, further comprising a paraffin dispersant which is a reaction product of fatty amines with compounds which contain at least one acyl group, the fatty amines being compounds of the formula $NR^6R^7R^8$ in which $R^6$, $R^7$ and $R^8$ may be the same or different, and at least one of $R^6$, $R^7$ and $R^8$ is $C_8$-$C_{36}$-alkyl, $C_6$-$C_{36}$-cycloalkyl, $C_8$-$C_{36}$-alkenyl, and the remaining $R^6$, $R^7$ and $R^8$ groups are hydrogen, $C_1$-$C_{36}$-alkyl, $C_2$-$C_{36}$-alkenyl, cyclohexyl, or a group of the formulae —$(A—O)_x$—E or —$(CH_2)_n$—NYZ, in which A is an ethyl or propyl group, x is from 1 to 50, E=H, $C_1$-$C_{30}$-alkyl, $C_5$-$C_{12}$-cycloalkyl or $C_6$-$C_{30}$-aryl, and n=2, 3 or 4, and Y and Z are each independently H, $C_1$-$C_{30}$-alkyl or —$(A—O)_x$.

14. The composition of claim 13, wherein at least one of $R^6$, $R^7$ and $R^8$ is $C_{12}$-$C_{24}$-alkyl, $C_{12}$-$C_{24}$-alkenyl or cyclohexyl.

15. A process for improving the electrical conductivity of mineral oil distillates having a water content of less than 150 ppm, by adding to the mineral oil distillates compositions which comprise at least one alkylphenol-aldehyde resin and, based on the alkylphenol-aldehyde resin, from 0.1 to 10 parts by weight of at least one nitrogen-containing polymer selected from the group consisting of a) a copolymer prepared by direct copolymerization of at least one nitrogen-containing comonomer with a further comonomer selected from the group consisting of an oil soluble ester of an ethylenically unsaturated carboxylic acid, an oil soluble vinyl ester, an oil soluble vinyl ether which bears a $C_4$- to $C_{40}$-alkyl radical or an olefin having from 6 to 42 carbon atoms,
b) a copolymer of ethylene with an ethylenically unsaturated nitrogen-containing comonomer, and
c) a polymeric polyamine, prepared by condensation of an aliphatic primary monoamine or of an N-alkylalkylenediamine with epichlorohydrin or glycidol, so that the mineral oil distillates have a conductivity of at least 50 pS/m.

16. A process for improving the electrical conductivity of mineral oil distillate having a water content of less than 150 ppm, and comprising from 0.1 to 200 ppm of at least one nitrogen-containing polymer selected from the group consisting of a) a copolymer prepared by direct copolymerization of at least one nitrogen-containing comonomer with a further comonomer selected from the group consisting of an oil soluble ester of an ethylenically unsaturated carboxylic acid, an oil soluble vinyl ester, an oil soluble vinyl ether which bears a $C_4$- to $C_{40}$-alkyl radical or an olefin having from 6 to 42 carbon atoms,
b) a copolymer of ethylene with an ethylenically unsaturated nitrogen-containing comonomer, and
c) a polymeric polyamine, prepared by condensation of an aliphatic primary monoamine or of an N-alkylalkylenediamine with epichlorohydrin or glycidol, by adding to the mineral oil distillate from 0.1 to 200 ppm of at least one alkylphenol-aldehyde resin, so that the mineral oil distillates have a conductivity of at least 50 pS/m.

17. An additive for mineral oil distillates having a water content of less than 150 ppm, which comprises at least one alkylphenol-aldehyde resin and at least one nitrogen-containing polymer, selected from the group consisting of a) a copolymer prepared by direct copolymerization of at least one nitrogen-containing comonomer with a further comonomer selected from the group consisting of an oil soluble ester of an ethylenically unsaturated carboxylic acid, an oil soluble vinyl ester, an oil soluble vinyl ether which bears a $C_4$- to $C_{40}$-alkyl radical or an olefin having from 6 to 42 carbon atoms, b) a copolymer of ethylene with an ethylenically unsaturated nitrogen-containing comonomer, and c) a polymeric polyamine, prepared by condensation of an aliphatic primary monoamine or of an N-alkylalkylenediamine with epichlorohydrin or glycidol, and mixtures thereof in a mass ratio of from 9:1 to 1:9.

* * * * *